US005136813A

United States Patent [19]

Gibbs et al.

[11] Patent Number: 5,136,813

[45] Date of Patent: Aug. 11, 1992

[54] CANTILEVER-TYPE SLIDING GATE

[75] Inventors: Edward L. Gibbs; Paul J. Bulten, both of Tulsa, Okla.

[73] Assignee: Fence Hardware Specialties, Inc. DBA Ameristar Fence Products, Tulsa, Okla.

[21] Appl. No.: 763,801

[22] Filed: Sep. 23, 1991

[51] Int. Cl.[5] ..... E06B 11/00

[52] U.S. Cl. ..... 49/404; 49/410; 49/426; 49/501

[58] Field of Search ..... 49/404, 409, 410, 411, 49/425, 426, 501

[56] References Cited

U.S. PATENT DOCUMENTS 4,628,638 12/1986 Elko et al. ..... 49/426
4,723,374 2/1988 Peterson et al. ..... 49/404
4,793,098 12/1988 Wilkerson ..... 49/501 X
5,022,185 6/1991 Oatman ..... 49/404 X

*Primary Examiner*—Philip C. Kannan
*Attorney, Agent, or Firm*—William S. Dorman; Molly D. McKay

[57] ABSTRACT

A cantilever-type gate which can be shipped in a disassembled kit and assembled at the job site using standard tools is disclosed. The top and bottom rail extrusions of the gate are modified to internally receive the vertical gate members which are bolted to the rails utilizing pre-drilled holes. Truss cables are used to hold the gate in a squared configuration. The gate is mounted on vertical supports for movement in a plane defined by the supports. The vertical supports have truck assemblies on which the gate is mounted and guide assemblies to keep the gate in alignment.

6 Claims, 6 Drawing Sheets

CANTILEVER-TYPE SLIDING GATE

BACKGROUND OF THE INVENTION

1. Field of the Invention

The present invention relates to a new cantilever-type sliding gate design and more particularly to a gate which is specially designed with a one piece top rail extrusion, one piece bottom rail extrusion, special truck assemblies and pre-drilled and pre-punched components which can be shipped as a disassembled kit and can be assembled at the job site using standard tools.

2. The Prior Art

Gates have been known since ancient times. One of the problems presented by the conventional swing-type gate was the large amount of space required for the gate to swing between the open and closed positions. Cantilever-type gates solved this problem by sliding along a plane parallel with the opening to be spanned. However, the advent of cantilever gates presented a whole new set of problems and limitations to be overcome.

One problem of the cantilever gate has been the exposed wheels on which the gate travelled. The exposed wheels would freeze up in icy weather or become clogged with snow, dirt or debris which accumulated on them. The exposed wheels were also a safety hazard to users or to young children who played on the gates because human fingers could become pinched or mashed by the wheels as the gate was opened or closed.

U.S. Pat. No. 4,628,638 addresses this problem with a support system designed for retrofitting an existing gate. One portion of the retrofit support system bolts onto the top of an existing gate and includes a covered compartment in which the supporting wheels travel. The supporting wheels are included with the other portion of the retrofit support system which bolts onto the existing support posts. However, this retrofit does not address the need for a gate originally designed to include these features.

Another problem with cantilever-type gates has been availability and cost of transportation for fully assembled gates to the installation site particularly if the gates were greater than 27 feet in length.

U.S. Pat. No. 4,723,374 attempted to address the transportation problem by utilizing pre-assembled double trussed panels which are transported to the installation site and bolted together on-site to form the gate. However, because of the bulk of these pre-assembled panels, they were hard to handle and when damaged, required replacement of the entire panel.

Still another problem with cantilever-type gates has been that their welded and pre-assembled construction hindered on-site repair of the gates by users. The present invention addresses this problem by providing a gate composed of individual components which are small and easily fastened together so that the user can repair the gate on site using standard tools. Repair of the present invention involves only replacement of the damaged components, not the entire panel or entire gate.

SUMMARY OF THE INVENTION

The present invention is designed to overcome the problems of prior cantilever-type gates as discussed above. The gate's components and hardware can be shipped in an single palletized bundle, reducing the cost of shipping, eliminating freight damage, and complying with common carrier maximum length requirements.

For gates over about 27 feet in length, splices for the top and bottom rail extrusions can be used to attain the needed finished length. The pre-drilled and pre-punched components may be assembled at the installation site using only standard tools. If the gate is damaged, the user can obtain a replacement part and fix the gate himself.

The top and bottom rail extrusions of the gate are about 60% heavier than those of conventional gates. The heavier rails are stronger and hold the gate straight, preventing sagging. The gate also utilizes double truss cables to hold the gate straight.

The gate's top rail extrusion is a one-piece design containing two compartments, a smaller compartment open on its downward face and a larger compartment also open on its downward face and having shoulders extending above and below the smaller compartment for securing upright members.

The smaller compartment in the top rail extrusion serves as a means for mounting the assembled gate on wheels of truck assemblies mounted on support posts. The smaller compartment has an opening facing downward through which the bottom mounted wheels of the truck assemblies are admitted into the compartment where they roll, protected from the elements. The smaller compartment shields human fingers from contact with the rolling wheels.

The larger compartment in the top rail extrusion serves as a bracket for bolting the gate's upright structural components to the top rail extrusion to form the upper portion of the gate's frame. This compartment is large enough in diameter to accommodate the upright members and has shoulders extending above and below the smaller compartment through which bolts may pass to secure the upper portion of the gate's upright members to the top rail extrusion.

The bottom rail extrusion serves as a bracket for bolting the lower portion of the upright structural components to the bottom rail extrusion to complete the gate's frame. The bottom rail extrusion is formed in an inverted U-shape and has pre-punched holes on its upward face to admit the lower portion of the gate's upright members. The sides of the bottom rail extrusion also serve as a track on which the wheels of the guide truck assemblies roll preventing the bottom of the gate from swinging and holding the gate in alignment with the support posts.

Briefly, the present invention is a gate assembly, carried by support means. In a preferred embodiment, the support means includes at least two vertical posts adjacent to the gap to be spanned and both located on the same side thereof, the two supports defining the closure plane across the gap. The gate is carried on the support members by a truck assembly including bearing wheels for allowing free sliding movement, with a guide roller assembly for maintaining the gate oriented parallel to the closure plane.

The top rail extrusion, the two end uprights and the bottom rail extrusion are bolted together to form a rectangular gate frame. Additional uprights are bolted into the rectangular frame parallel to and evenly spaced between the end uprights. To increase the structural rigidity of the gate, the rectangular frame is single trussed with cable between the end uprights and the adjacent additional uprights and double trussed between two adjacent additional uprights. Conventional chain link type material is used to cover the rectangular gate frame or, alternately, decorative pickets can be used between and parallel to the uprights.

Although the preferred embodiment is a cantilever-type sliding gate, other types of gates can be constructed according to the present invention.

DETAILED DESCRIPTION OF THE PREFERRED EMBODIMENTS

Figure 9:
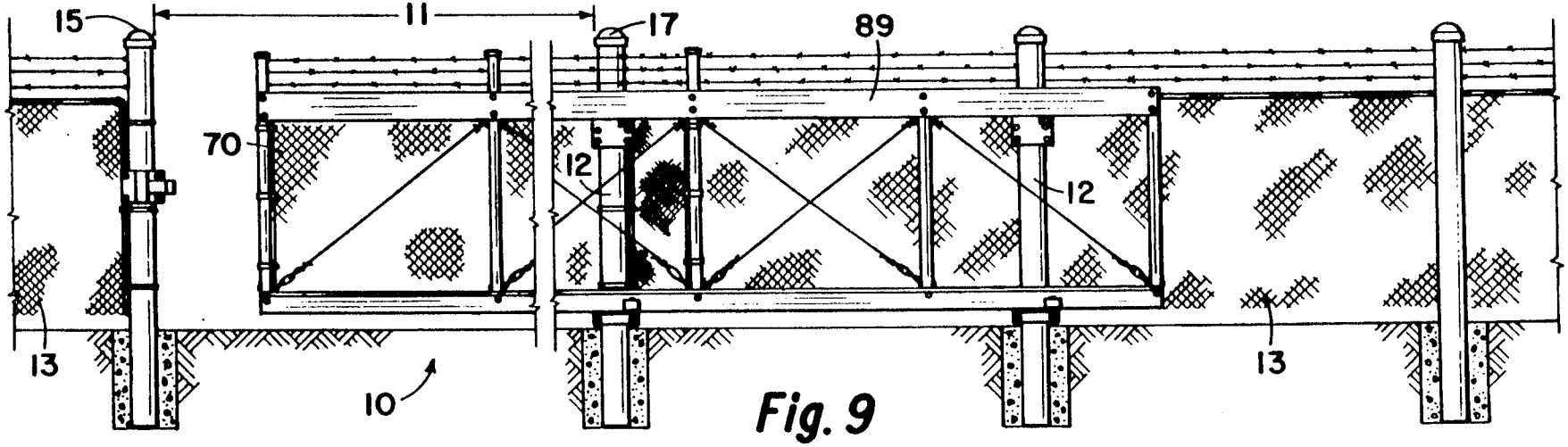
FIG. 9 is a front view of a gate constructed according to the present invention utilizing chain link fencing fabric.

Referring now to FIG. 9, a portion of a cantilever-type gate 10 is shown which incorporates the teaching of the current invention. The general environment for the invention includes a gap 11 to be spanned, typically a roadway, and a perimeter fence 13, often of the chain-link variety, located on each side of the gap 11 and defining the gap 11. The fence on one side of the gap is a gate-receiving side of the fence 15 and the fence on the other side of the gap is a gate-supplying side of the fence 17.

Generally, at least two supporting posts 12 are located on the gate-supplying side of the fence, one located adjacent to the gap to be spanned and the other spaced some distance from the first in the plane adjacent to the gate-supplying side of the fence and parallel to the gap to be spanned.

Figure 1:
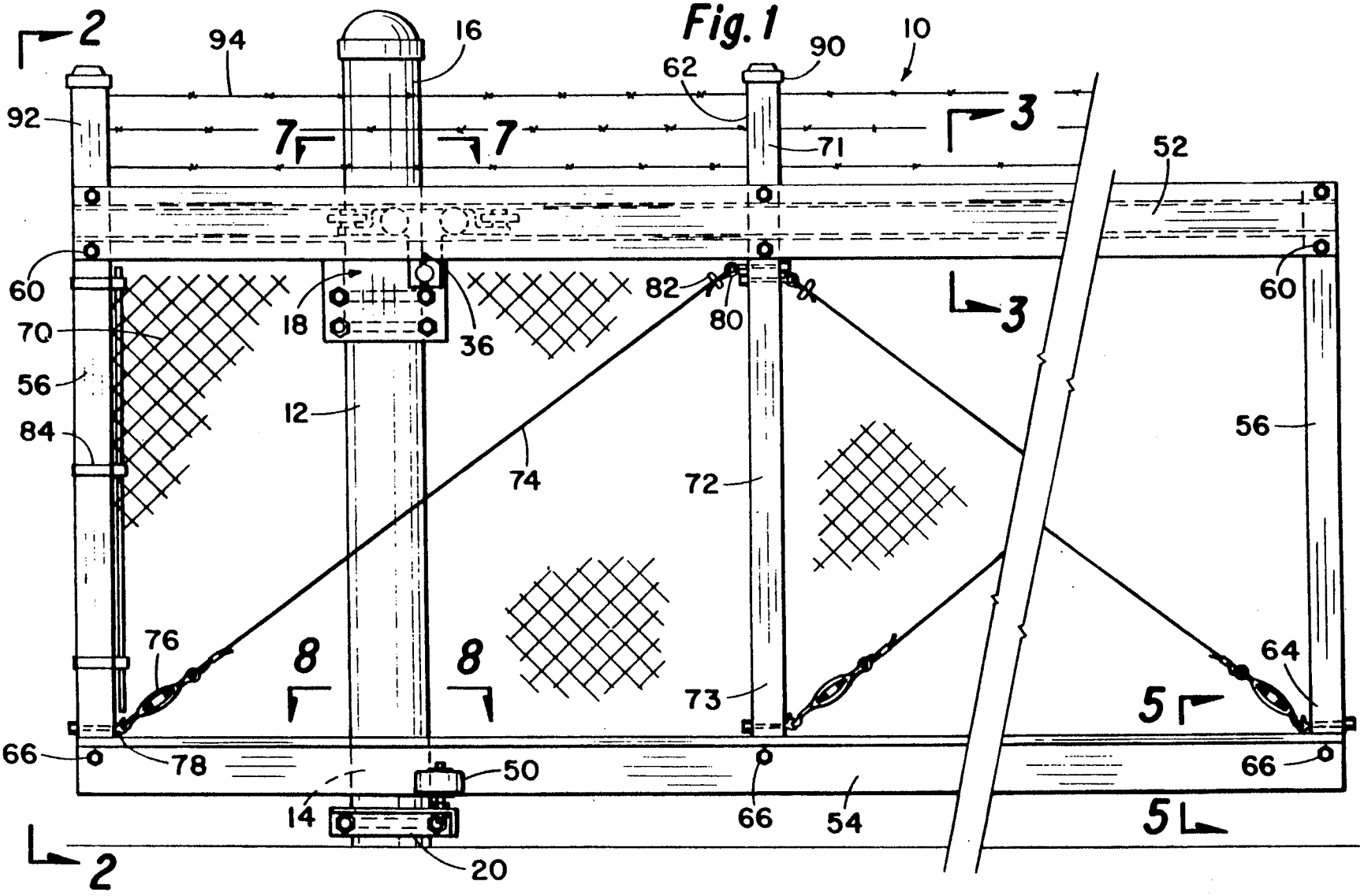
FIG. 1 is a front view of a portion of a gate constructed according to present invention.

Referring to FIG. 1, said support posts 12 define the plane in which the gate 10 will slide when supported by said support posts 12. Said support posts 12 each have two ends, a bottom end 14 and a top end 16. The bottom ends 14 of said support posts 12 are securely fastened to the earth with cement or other suitable means and the top ends 16 extend into the air, perpendicular to the earth.

Figure 2:
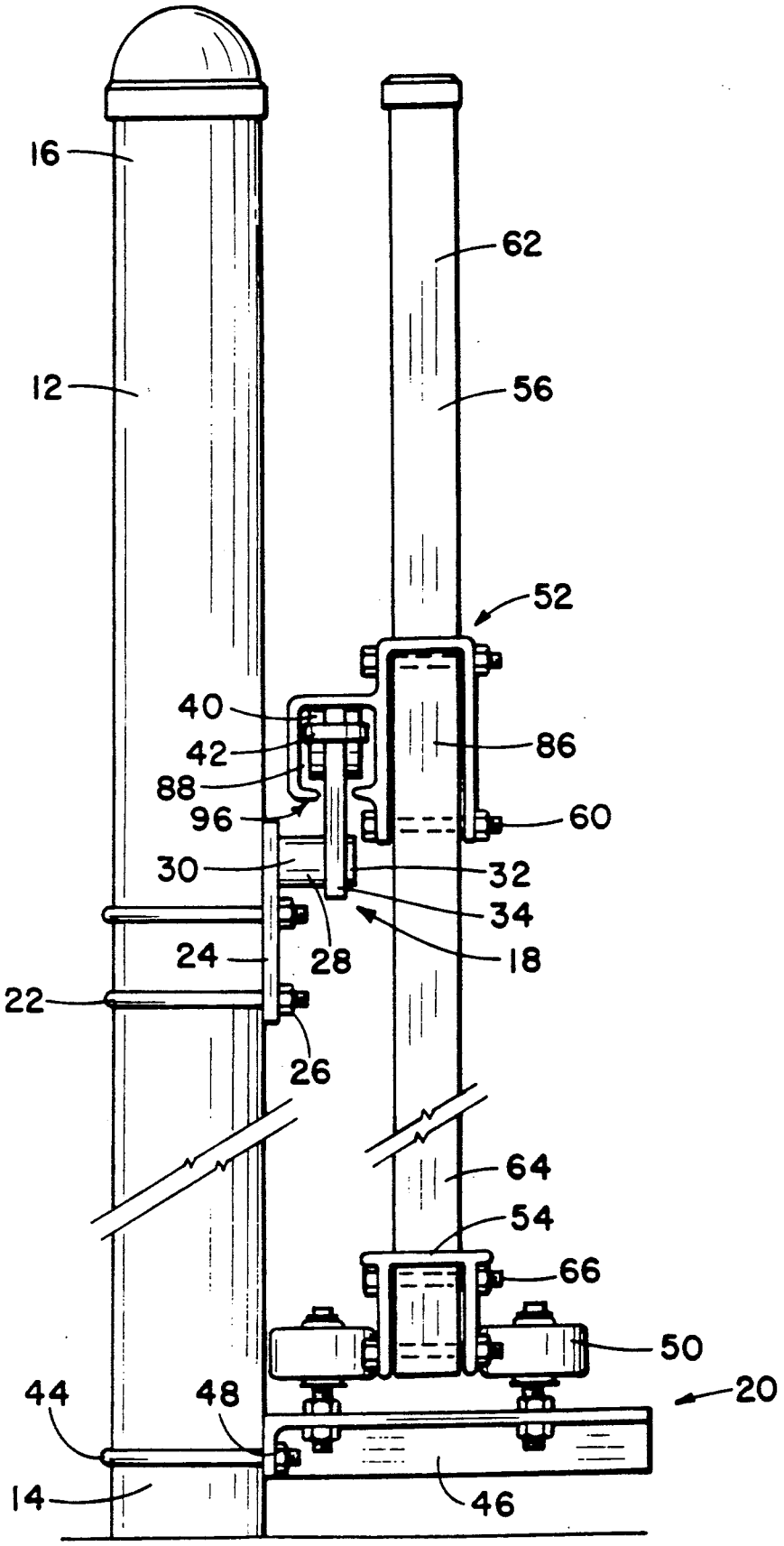
FIG. 2 is a cross-sectional view taken on plane 2—2 of FIG. 1.

As shown in FIG. 2, each support post 12 has an upper roller assembly 18 attached near the top end 16 of the support post 12 and has a bottom guide roller assembly 20 attached near the bottom end 14 of the support post 12.

Figure 7:
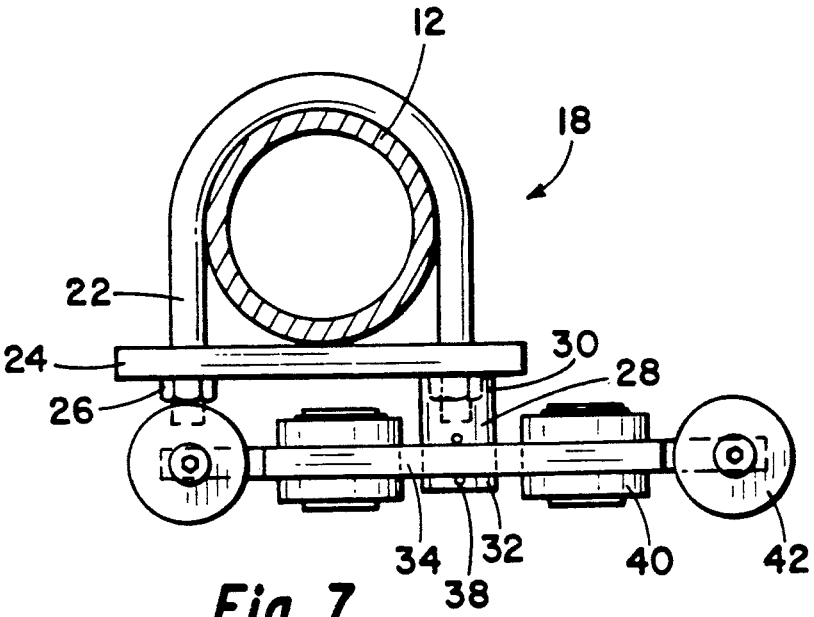
FIG. 7 is a cross sectional view taken on plane 7—7 of FIG. 1, with the gate portion omitted.

Referring to FIG. 7, the upper roller assembly 18 attaches to the support post 12 by means of U-bolts 22 which extend around the support post 12, through a flat truck bracket 24 and are held in place by nuts 26 which are placed on the ends of the U-bolts 22. Said truck bracket 24 contains a shaft 28 which extends perpendicular to the plane of the truck bracket 24. Said shaft 28 has two ends, one end 30 attached to the truck bracket 24 and a second end 32 extending away from it. The second end 32 of said shaft 28 is attached to a truck assembly 34 by way of cotter pins 36 (shown in FIG. 1) which insert in said shaft 28 through pre-drilled holes 38 located in shaft 28. The truck assembly 34 has attached to it vertically mounted support rollers 40 located adjacent and on each side of shaft 28 and horizontally mounted support rollers 42 located adjacent to the vertically mounted support rollers 40.

Figure 8:
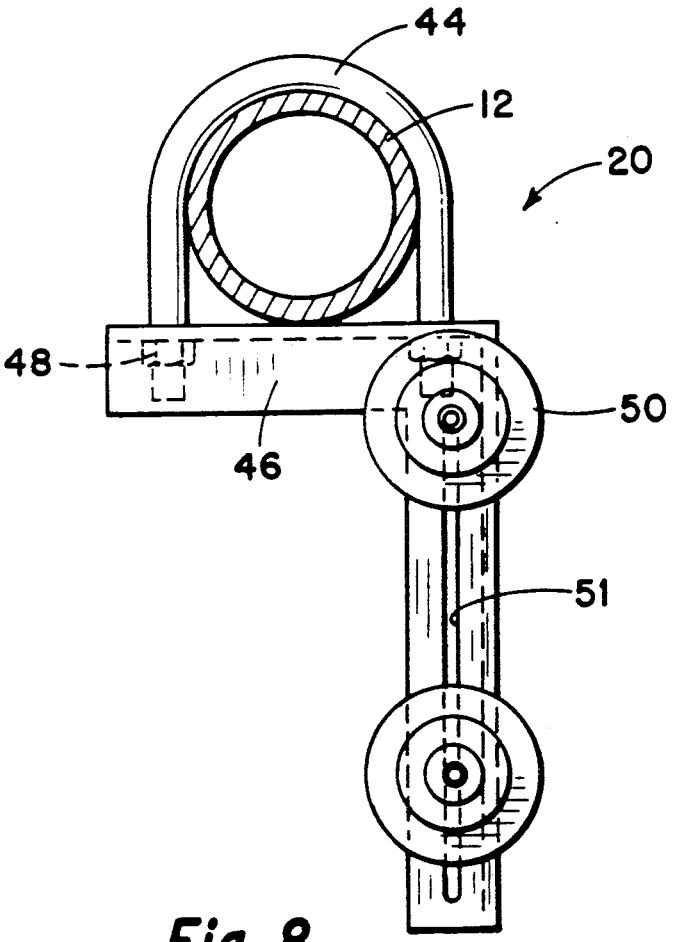
FIG. 8 is a cross sectional view taken on plane 8—8 of FIG. 1, with gate portion omitted.

Referring to FIG. 8, the bottom guide roller assembly 20 attaches to a support post 12 by means of a U-bolt 44 which extends around the support post 12, through an L-shaped guide bracket 46 and is held in place by nuts 48 which are placed on the ends of the U-bolt 44. Guide rollers 50 attach directly to the guide bracket 46 via a slot 51 in said bracket 46 designed to facilitate adjustment of said guide rollers 50.

Figure 10:
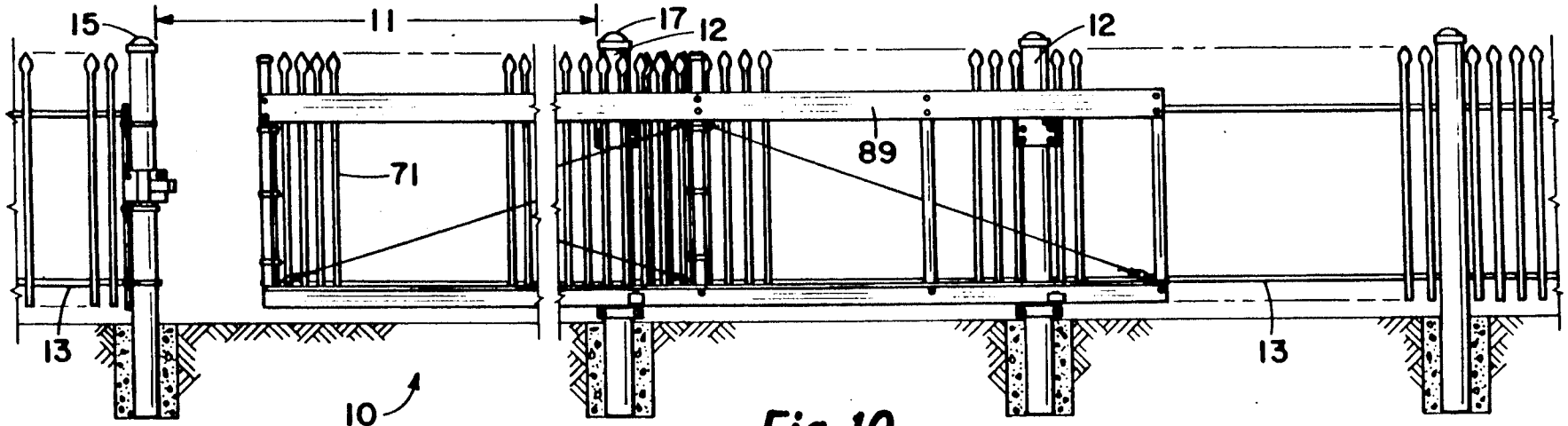
FIG. 10 is a front view of a gate constructed according to the present invention utilizing decorative pickets.

As shown in FIG. 9 and 10, the gate 10 can be built utilizing either conventional chain-link material 70 or decorative pickets 71.

Referring now to FIG. 1, the gate 10 is supported at its perimeter by a top rail extrusion 52, a bottom rail extrusion 54, and two end upright gate members 56. The length of the top rail extrusion 52 and the length of the bottom rail extrusion 54 exceed the distance between the two support posts 12 by the distance of the gap to be spanned by the gate 10. For particularly long applications, longer gates 10 can be made by utilizing a splice (not illustrated) to hold together two top rail extrusions 52 and another splice (not illustrated) to hold together two bottom rail extrusions 54.

The top rail extrusion 52 has two ends, pre-drilled holes for bolts 60, and pre-punched holes 58 for admitting end uprights 56 and additional upright gate members 72. If the gate will be utilizing decorative pickets 71 instead of chain link fencing material 70, the top rail extrusion 52 will also have pre-punched holes (not illustrated) for admitting the pickets 71.

The end uprights 56 have an upper end 62 and a lower end 64 and pre-drilled holes for bolts 60 in the upper end 62 and pre-drilled holes for bolts 66 in the lower end 64.

Figure 5:
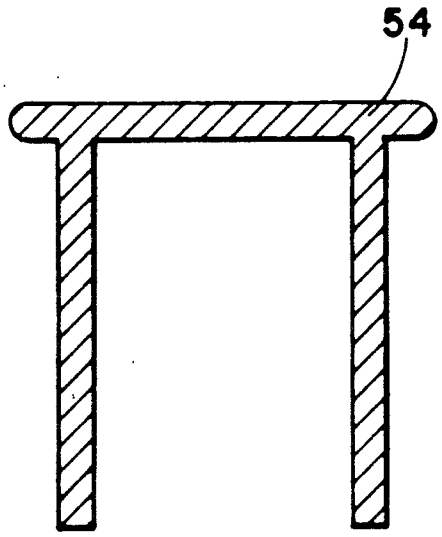
FIG. 5 is a cross-sectional view taken on plane 5—5 of FIG. 1.
Figure 6:
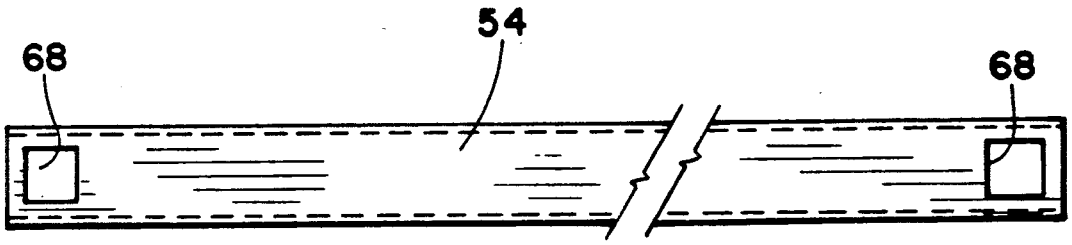
FIG. 6 is a top view of FIG. 5.

Referring to FIGS. 5 and 6, the bottom rail extrusion 54 has two ends, pre-drilled holes for bolts 66, and pre-punched holes 68 for admitting end uprights 5 and additional uprights 72. If the gate 10 will be utilizing decorative pickets 71 instead of attaching chain link fencing material 70 to the gate 10, the bottom rail extrusion 54 will also have pre-punched holes (not illustrated) for admitting the pickets 71.

Each end of the top rail extrusion 52 is fastened to the upper end 62 of one end upright 56 by bolts 60 which extend through pre-drilled holes in the top rail extrusion 52 and the end upright 56. The ends of the bottom rail extrusion 54 are positioned with the lower ends 64 of the end uprights 56 to form a rectangle; the lower ends 64 of the end uprights 56 are then fastened to the bottom rail extrusion 54 by bolts 66 which extend through pre-drilled holes in the bottom rail extrusion 54 and the end uprights 56.

To provide more stability to the frame, additional uprights 72 are added by attaching them to the top rail extrusion 52 and the bottom rail extrusion 54 in locations parallel to and evenly spaced between the end uprights 56. The additional uprights each have an upper end 71 and a lower end 73. The upper ends 71 of the additional uprights 72 are bolted to the top rail extrusion 52. The lower ends 73 of the additional uprights 72 are attached to the bottom rail extrusion 54 with only one bolt 66 located so the bottom guide rollers 50 will roll below them along the bottom rail extrusion 54 below the bolts 66.

Truss cables 74 with pre-attached turnbuckles 76 are added to the end uprights 56 and the adjacent additional uprights 72 to provide additional support. The turnbuckle 76 attaches to an eye bolt 78 which is inserted through a pre-drilled hole in the end upright 56 near the point where the end upright 56 attaches to the bottom rail extrusion 54. The truss cable 74 is then looped through an eye bolt 80 which is inserted through a pre-drilled hole in the upper end of the adjacent upright 72 near the point where the upright 72 fastens to the top rail extrusion 52. The loose end of the truss cable 74 is then pulled back on itself and secured by means of a cable clamp 82.

Two truss cables 74 are used in a crisscross fashion on all the remaining uprights 72, utilizing the same manner of attachment for the remaining cables 74 as described for the end uprights 56. Once all truss cables 74 are in place, the end uprights 56 are squared with the top rail extrusion 52 and the bottom rail extrusion 54. Once the gate 10 is squared, the turnbuckles 76 are turned to adjust the tension of the cables 74, thus helping to hold the gate 10 in place.

Once the supporting elements of the gate 10 are assembled, conventional chain link type material 70 is attached to the frame utilizing tension bands 84, eye bolts (not illustrated), direct attachment or other suitable means of attachment. If the gate 10 will be utilizing decorative pickets 71 instead of chain link fencing material 70, the decorative pickets 71 are inserted through pre-punched holes (not illustrated) in the top rail extrusion 52 and pre-punched holes (not illustrated) in the bottom rail extrusion 54 and are secured in place by rivets (not illustrated).

Figure 3:
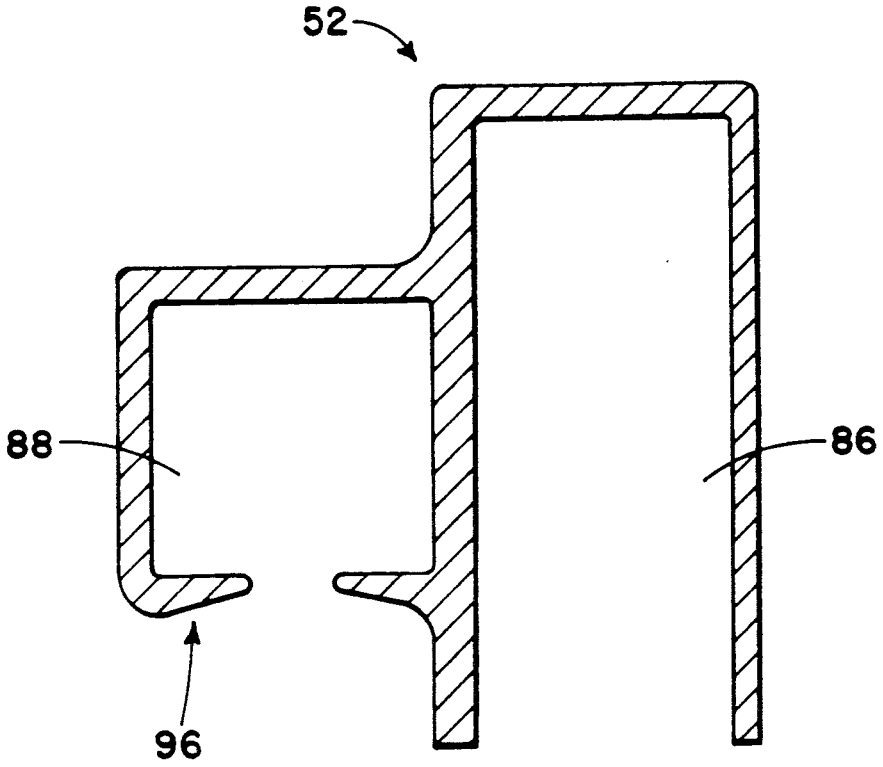
FIG. 3 is a cross-sectional view taken on plane 3—3 of FIG. 1.
Figure 4:
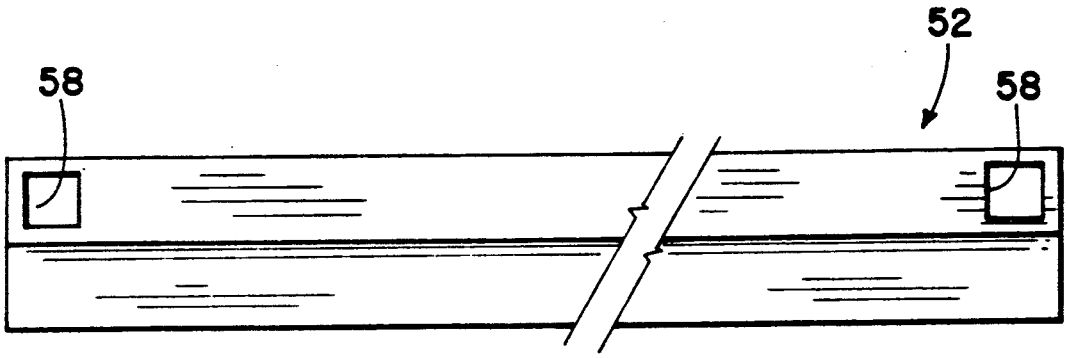
FIG. 4 is a top view of FIG. 3.

Referring to FIG. 3, the top rail extrusion 52 is specially designed with two separate compartments, one larger compartment 86 and one smaller compartment 88.

The larger compartment 86 is of sufficient diameter to accommodate the end uprights 5 and the additional uprights 72. The compartment 86 extends above and below the smaller compartment 88 providing shoulders through which bolts 60 may pass to secure the end uprights 56 and the additional uprights 72 to the top rail extrusion 52. The larger compartment 86 is open at both ends of the top rail extrusion 52 and open on the side of the larger compartment 86 which faces the bottom rail extrusion 54. The upper ends 62 of the end uprights 56 and the upper ends 71 of the additional uprights 72 extend through the top rail extrusion 52 via pre-drilled holes 58 which are located along the top rail extrusion 52 except in a counterbalance region 89 of the gate 10 which is illustrated in FIG. 9.

The terminal portions of the upper ends 62 of the end uprights 56 and terminal portions of upper ends 71 of the additional uprights 72 can be capped with ornamental tops 90. The upper ends 62 of the end uprights 56 and the upper ends 71 of the additional uprights 72 can also be utilized as barb arms 92 for attaching barbed wire 94. If the gate 10 will be utilizing decorative pickets 71 instead of chain link fencing material 70, the upper ends 62 of the end uprights 56, the upper ends 71 of the additional uprights 72 and the portions of the pickets 71 which extend above the top rail extrusion 52 can have various ornamental treatments (not illustrated).

The smaller compartment 88 of the top rail extrusion 52 has a bottom side 96 which faces toward the bottom rail extrusion 54. The smaller compartment 88 is open on its bottom side 96 and open at each end of the top rail extrusion 52. The top rail extrusion 52 of the assembled gate 10 rides on the vertically mounted support rollers 40 and the horizontally mounted support rollers 42 of the upper roller assemblies 18 which extend into the smaller compartment 88 by way of the opening on the bottom side 96 of the smaller compartment 88. Placement of the gate 10 on the upper roller assemblies 18 is facilitated by the openings in the smaller compartment 88 located at the ends of the top rail extrusion 52.

In view of the foregoing it should appear that all of the gate components can be shipped in a single palletized bundle and assembled on-site using standard tools.

Whereas the present invention has been disclosed in terms of the specific structure described above, it should be understood that other and further modifications, apart from those shown or suggested herein, may be made within the spirit and scope of this invention.

What is claimed is:

1. A gate system which is assembled from components to form a planar gate structure having a height dimension and a length dimension for spanning a predetermined gap, the gate system comprising:

two spaced gate posts each provided with an upper roller assembly and a bottom guide roller assembly with spaced wheels;

a one piece top rail extrusion containing two adjacent horizontally oriented compartments along its length, one compartment being larger than the other compartment, the larger compartment having an upward facing side and a downward facing side, the downward facing side being open, the upward facing side containing pre-punched holes to accommodate upright gate members, the larger compartment being large enough in diameter to accommodate upright gate members, the larger compartment extending above and below the smaller compartment providing shoulders through which bolts may pass to secure the upright gate members to the upper rail extrusion, the smaller compartment having an upward facing side and a downward facing side, the upward facing side being closed and the downward facing side having an opening through which the upper roller assemblies extend into the smaller compartment forming a covered track for the upper roller assemblies;

upright gate members having two ends, one end of each upright gate member being attached to the upper rail extrusion;

a bottom rail extrusion attached to the other ends of the upright gate members, the bottom rail extrusion rolling between the spaced wheels of the bottom guide roller assembly.

2. A gate according to claim 1 wherein the bottom rail extrusion is U-shaped with the open end of the U-shape facing downward and the closed end of the U-shape facing upward, the upward facing side containing pre-punched holes to accommodate the upright gate members, the sides of the U-shaped extrusion being spaced far enough apart to accommodate upright gate members which are inserted through the pre-punched holes and fastened into place between the sides of the bottom rail extrusion.

3. The gate according to claim 1 further comprising:

a covering of chain link material attached to the planar gate structure.

4. A gate according to claim 1 further comprising:

decorative pickets attached to the top rail extrusion and the bottom rail extrusion parallel to the upright gate members.

5. A gate according to claim 1 wherein the upper roller assembly attaches to the gate post by means of U-bolts inserted through a flat truck bracket, a shaft extending perpendicular from the flat truck bracket, a truck assembly fastened to the shaft, the truck assembly having vertically mounted support rollers located adjacent and on each side of the shaft and horizontally mounted support rollers located adjacent to the vertically mounted support rollers.

6. A gate according to claim 1 wherein the bottom guide roller assembly attaches to the gate post by means of a U-bolt inserted through a guide bracket, spaced guide rollers attached to the guide bracket through a slot in the guide bracket to facilitate adjustment of the guide rollers.

* * * * *